United States Patent [19]

Dressel et al.

[11] 4,041,717

[45] Aug. 16, 1977

[54] SAND SHIELD JET SLED

[75] Inventors: Edwin J. Dressel, New Orleans; Houston W. Hunter, Marrero, both of La.

[73] Assignee: J. Ray McDermott & Co., Inc., New Orleans, La.

[21] Appl. No.: 707,251

[22] Filed: July 21, 1976

[51] Int. Cl.[2] ..... E02F 5/02; E02F 1/00

[52] U.S. Cl. ..... 61/72.4; 37/63; 61/105

[58] Field of Search ..... 61/72.4, 72.6, 105; 37/54, 81, 62-65, 80, 77; 172/40

[56] References Cited

U.S. PATENT DOCUMENTS

| | | | |
|---|---|---|---|
| 3,368,358 | 2/1968 | Elliott | 61/72.4 |
| 3,504,504 | 4/1970 | Elliott | 61/72.4 |
| 3,732,701 | 5/1973 | Lynch | 61/72.4 |
| 3,751,927 | 8/1973 | Perot | 61/72.4 |
| 3,824,798 | 7/1974 | Shiroyama et al. | 61/72.4 |
| 3,877,238 | 4/1975 | Chang et al. | 61/72.4 |

*Primary Examiner*—Dennis L. Taylor
*Attorney, Agent, or Firm*—Arnold, White & Durkee

[57] ABSTRACT

An apparatus for burying a pipeline in a seabed comprising unconsolidated materials such as sand. The apparatus includes a jet sled having jetting legs for disposition on opposite sides of the pipeline to direct a stream of high pressure water into the seabed to form a trench for the pipeline, and an elongate member extending rearwardly of the jet sled having shields depending therefrom to physically restrain the walls of the trench from caving-in and filling the trench beneath the unsupported portion of the pipeline. In addition, fluid jet nozzels are carried along each of the shields providing a mild turbulence at the lower edge of the shields to assist in keeping sand out of the trench and maintain the bottom of the trench in a fluidized condition. The elongate member comprises a pair of ballast tanks which may be selectively ballasted or deballasted to raise and lower the sand jet sled apparatus within the water, and to assist the settling of the pipeline into the seabed.

21 Claims, 6 Drawing Figures

SAND SHIELD JET SLED

BACKGROUND OF THE INVENTION

The present invention relates to an apparatus for burying a pipeline in the bottom of a body of water, and more particularly relates to a jet sled for entrenching a pipeline in a seabed consisting of unconsolidated material.

It has become common practice to entrench submerged marine pipelines beneath the surface of the ocean floor. This has been found necessary to prevent damage to the pipeline, as was experienced when pipelines were laid and left to rest uncovered upon the ocean floor.

Conventional apparatus for entrenching a submerged pipeline has included a submerged jet sled. Typical jet sleds include a frame structure for straddling the pipeline with port and starboard pontoon runners to support the structure. A conventional jet sled is provided with port and starboard high pressure jetting nozzles which, upon being supplied with fluid, such as air or water, dislodge soil from the seabed to form a trench for the pipeline. The jet sled is pulled along the ocean floor by a surface vessel which also supplies the necessary high pressure fluid for the jetting nozzles.

The conventional jet sled works quite well in seabed formations consisting of cohesive materials. However, when a pipeline is desired to be buried in a seabed consisting of unconsolidated materials such as sand, clay or other sedimentary materials, difficulty has been experienced in keeping the trench from filling up before the pipeline can come to rest at the proper depth within the trench. Problems of this type are especially acute when a pipeline is desired to be buried in a seabed consisting almost entirely of sand.

One approach to burying a pipeline in the bottom of a body of water consisting of an unconsolidated material is that of fluidizing the sea bottom proximate the pipeline, thereby permitting the pipe to sink by its own weight into the fluidized sea bottom. This approach to pipeline burying does not involve the formation of a trench in front of the pipeline, but rather the entire burying operation is accomplished by a series of fluidizing sleds spaced at intervals indisposed underneath the pipeline to locally fluidize the bottom material. This approach to pipeline burying is illustrated by De Geeter, U.S. Pat. No. 3,659,425.

Another approach to the problem of burying pipelines in unconsolidated seabed material involves the disposition around the underside of the pipeline of a number of tubes having fluidization openings or jets provided along their length. The tubes extend completely around the underside of the pipeline and are held in place by a number of spaced apart yokes. Fluid is released under high pressure through the openings into the bottom adjacent to the pipeline in order to fluidize the unconsolidated material. The weight of the pipeline will cause the pipeline to sink into the fluidized bottom material until it has reached the desired depth. This approach to pipeline burying is disclosed in Van Steveninck, U.S. Pat. No. 3,702,540.

Another effort to overcome the problem of pipeline burying in unconsolidated seabeds is that of providing fluidization pipes affixed to and running along the pipeline to fluidize the seabed around the pipeline, causing the pipeline, together with the fluidization pipes, to sink into the fluidized seabed. This approach is that of Van Steveninck, U.S. Pat. No. 3,695,049.

The foregoing approaches to burying pipelines in seabeds comprising unconsolidated material have involved the fluidization of the seabed material adjacent to pipeline to permit the pipeline to sink by its own weight into the fluidized bottom material. All of the foregoing techniques dispense with the formation of a trench ahead of the pipeline and utilize local fluidization.

Another characteristic of the foregoing described techniques for burying a pipeline in a seabed consisting of unconsolidated material is that all require that a great amount of fluid be released from the fluidization nozzles in order to maintain the seabed material in a completely fluidized state as is necessary for satisfactory pipeline burial.

SUMMARY OF THE INVENTION

In accordance with the present invention, there is provided an apparatus for entrenching an elongate structure, such as a pipeline or cable, in the seabed of a body of water. Specifically, the instant invention provides an apparatus which may be used to entrench a pipeline in a seabed that substantially comprises unconsolidated materials such as sand or clay.

When a pipeline is to be buried in a seabed that consists primarily of sand, or like sedimentary material, it is necessary, after a trench has been formed to accommodate the pipeline, that the trench does not fill-in beneath the pipeline before it can come to rest at the bottom of the trench. Accordingly, to effectively entrench a pipeline or like structure in a trench formed within a seabed comprised of unconsolidated material, it is necessary to prevent the filling-in of the trench beneath the unsupported segment of the pipeline.

In accordance with this invention, there is provided an apparatus for entrenching a pipeline in an unconsolidated seabed of a body of water, which apparatus comprises a jet sled adapted to straddle a pipeline laying on the seabed and having jet legs depending downwardly for forming a trench in the seabed to accommodate the pipeline, and an elongate member extending from the rear of the jet sled having shields secured thereon for disposition in the trench on opposite sides of the unsupported segment of the pipeline extending between the surface of the seabed and the bottom of the trench. The shields provided on the elongate member prevent unconsolidated material from filling the trench beneath the unsupported length of the pipeline by physically restraining the walls of the trench to prevent their collapse.

In a more specific embodiment of the present invention, the apparatus includes a plurality of fluid jet nozzles disposed along the shields for creating a slight fluid flow directed against the walls of the trench to further assist in preventing unconsolidated material from filling in beneath the unsupported segment of the pipeline being buried.

In a yet more specific embodiment of the present invention, the elongate member includes a ballast tank having apparatus associated therewith for selectively ballasting and deballasting the tank to effect a raising or lowering of the sand jet sled within a body of water. Preferably, the elongate member comprises a pair of tanks divided into a plurality of sections with each of the sections being provided with a compressed air line for introducing air into the tank segment to blow ballast seawater giving the elongate member a positive buoyancy.

In another aspect of the present invention, there is provided an apparatus for entrenching a pipeline in an unconsolidated seabed of a body of water, which fluidizes the seabed and forces the pipeline into the fluidized seabed to the desired depth. The apparatus comprises an elongate member having jetting nozzles attached thereto for projection into the seabed on opposite sides of the pipeline to maintain the seabed proximate the pipeline in a fluidized state. The elongate member carries a series of rollers at spaced locations along the elongate member for bearing engagement with the pipeline, which rollers extend to increasingly greater distances beneath the elongate member toward the aft portion of the elongate member. Ballast weight secured to the elongate member acts upon the pipeline through the bearing engagement of the rollers thereon to force the pipeline into the fluidized seabed.

Other aspects of this invention not outlined above will be covered in the detailed description presented below.

BRIEF DESCRIPTION OF THE DRAWINGS

A more complete appreciation of the invention may be had by reference to the accompanying drawings, illustrating a preferred embodiment of the invention to be described in detail, in which like reference numerals designate identical or corresponding parts throughout the several views and wherein.

DETAILED DESCRIPTION OF THE PREFERRED EMBODIMENT

Figure 1:
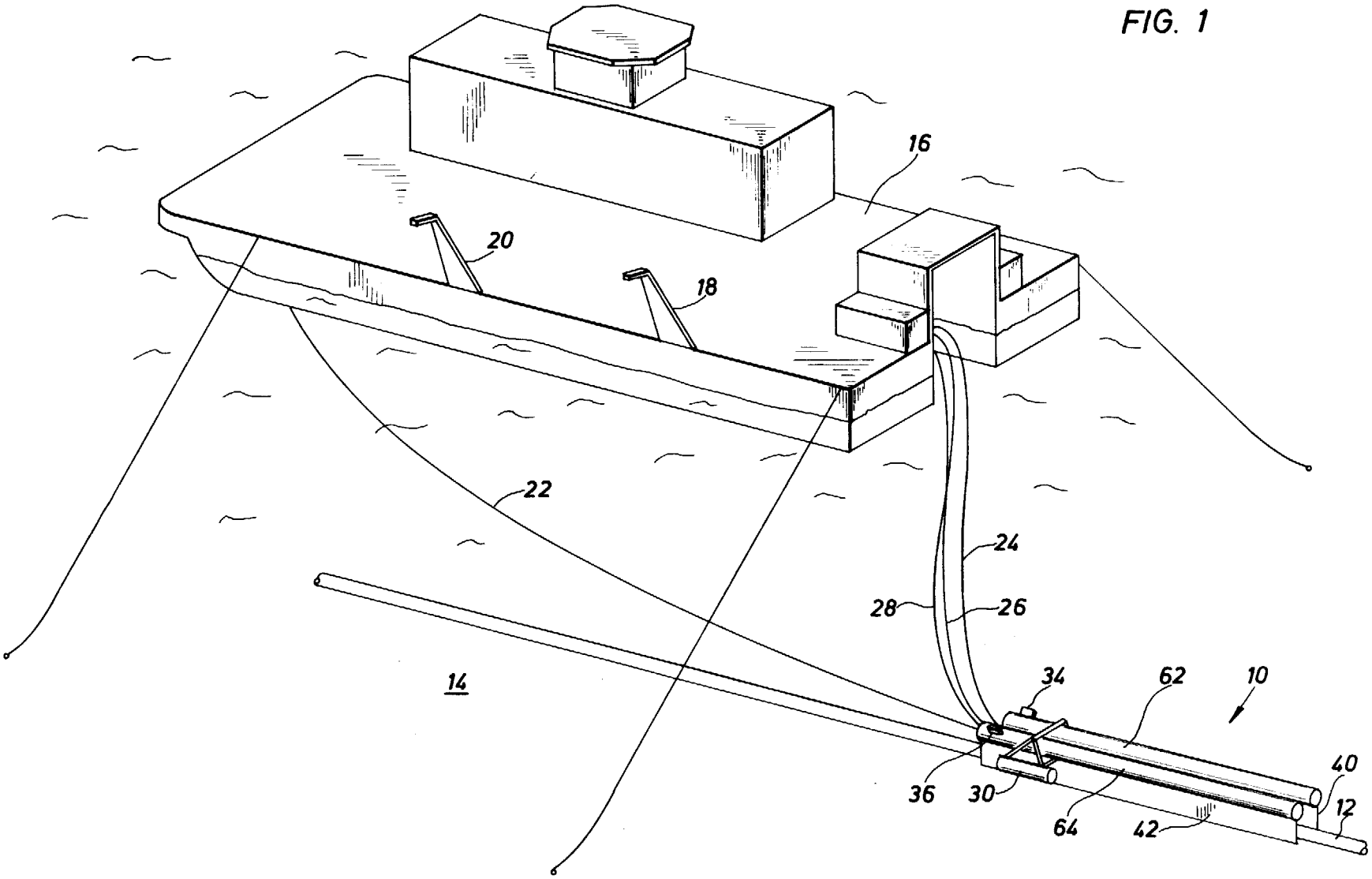
FIG. 1 is a perspective view of a sand jet sled in accordance with the present invention being towed along by a barge in position over a pipeline that is to be buried in a seabed of unconsolidated material.

Referring now to FIG. 1, there is shown an apparatus for entrenching pipeline 12 in the seabed 14 of a body of water. The seabed 14 may consist of unconsolidated materials, such as sand, clay or a combination of various types of sedimentary material. The apparatus includes a buoyant vehicle, referred to as barge 16, and a sand jet sled apparatus 10 in accordance with a preferred embodiment of the present invention. Barge 16 is adapted to tow sand jet sled apparatus 10 along the seabed of the body of water during the burying operation utilizing a tow line 22 that extends from the bow of barge 16.

Sand jet sled apparatus 10 is lowered into a stradding disposition over the pipeline 12 by means of cranes 18 and 20 located on the port side of barge 16. High pressure air and water pumps are located on board barge 16 along with other essential operational and power generation equipment. The air and water pumps disposed on barge 16 provide the necessary high pressure fluids via an air hose 24 and water hoses 26 and 28 that extend from the stern of barge 16. The high pressure water supply to sand jet sled apparatus 10 is directed downwardly toward the seabed to form a trench into which pipeline 12 may descend under its own weight, or be forced into the seabed by an external force acting on the pipeline.

Once sand jet sled 10 is in straddling disposition over pipeline 12, and the air and water hoses have been connected, a pipeline burying operation may commence with barge 16 towing the sand jet sled along the pipeline. Sand jet sled apparatus 10 slides above the pipeline 12 on outriggers 30, 32 and forms a trench in the unconsolidated seabed as it travels along. Dislodged material from the seabed 14 is removed from the trench by an air lift mechanism and expelled through air lift exhausts 34, 36.

To prevent the unconsolidated material that comprises the seabed from filling up the trench before the pipeline 12 can come to rest at the bottom of the trench, shields 40 are provided along the sides of sand jet sled apparatus 10 to physically hold the walls of the trench open and prevent unconsolidated material from filling up the trench beneath the unsupported portion of the pipeline. In addition, fluid jet nozzles may be distributed along the shields to provide a very small amount of fluid flow to assist in keeping unconsolidated material from filling the trench.

At the conclusion of a burying operation, the sand jet sled apparatus may be raised off the sea floor by deballasting the ballast tanks 62 and 64, causing the sand sled to float to the surface of the body of water. Once it is at the surface, it may be floated into position adjacent to barge 16, whereupon cranes 18 and 20 can be used to raise it out of the water.

Figure 2:
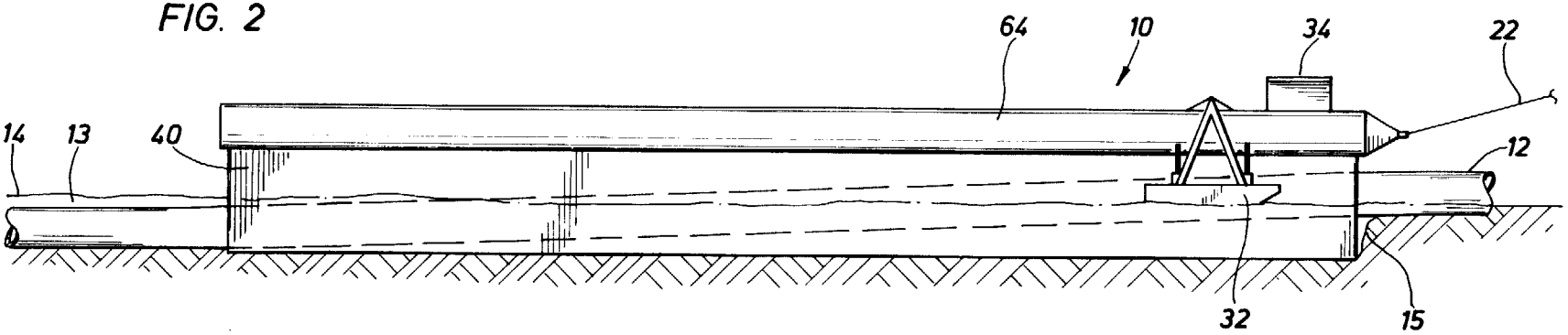
FIG. 2 is an enlarged side view of one embodiment of the sand jet sled and a segment of a pipeline that is being buried in a seabed by the apparatus.

As may be seen in more detail in FIG. 2, pipeline 12, at the portion thereof proximate the sand jet sled, is somewhat in the shape of an S. That is, the front portion of pipeline 12 ahead of the sand jet sled apparatus 10 rests on the surface of the seabed with the portion of the pipeline 12 behind sand jet sled 10 at the bottom of the trench 13. Between those portions of pipeline 12 that are either supported by the surface of seabed 14 or supported by the bottom of trench 13, there is an unsupported segment that exists behind the front edge 15 of trench 13. Pipeline 12 will typically be a 30-inch O.D. pipe having a one-half inch wall thickness and an outside water proofing and weighting coating of 3 to 4 inches applied, which gives the pipe a negative bouyancy in seawater. Thus, the pipe will have some tendency to sink to the bottom of the trench 13. However, due to the difference in height between the bottom of the trench and the surface of the seabed, a portion will remain unsupported. Typically, the trench formed will be approximately 10 feet deep, resulting in an unsupported length of approximately 50 to 100 feet.

As shown in FIG. 2, the shields, of which only shield 40 is visible, will restrain the side walls of trench 13 to prevent the caving in of the unconsolidated material comprising the trench wall. However, once the sand jet sled apparatus 10 has passed beyond a particular segment of the pipeline 12, the walls of trench 13 adjacent that segment are allowed to cave-in and cover over the pipeline 12. This is illustrated in FIG. 2 at the portion of the seabed 14 that exists behind sand jet sled apparatus 10.

Figure 3:
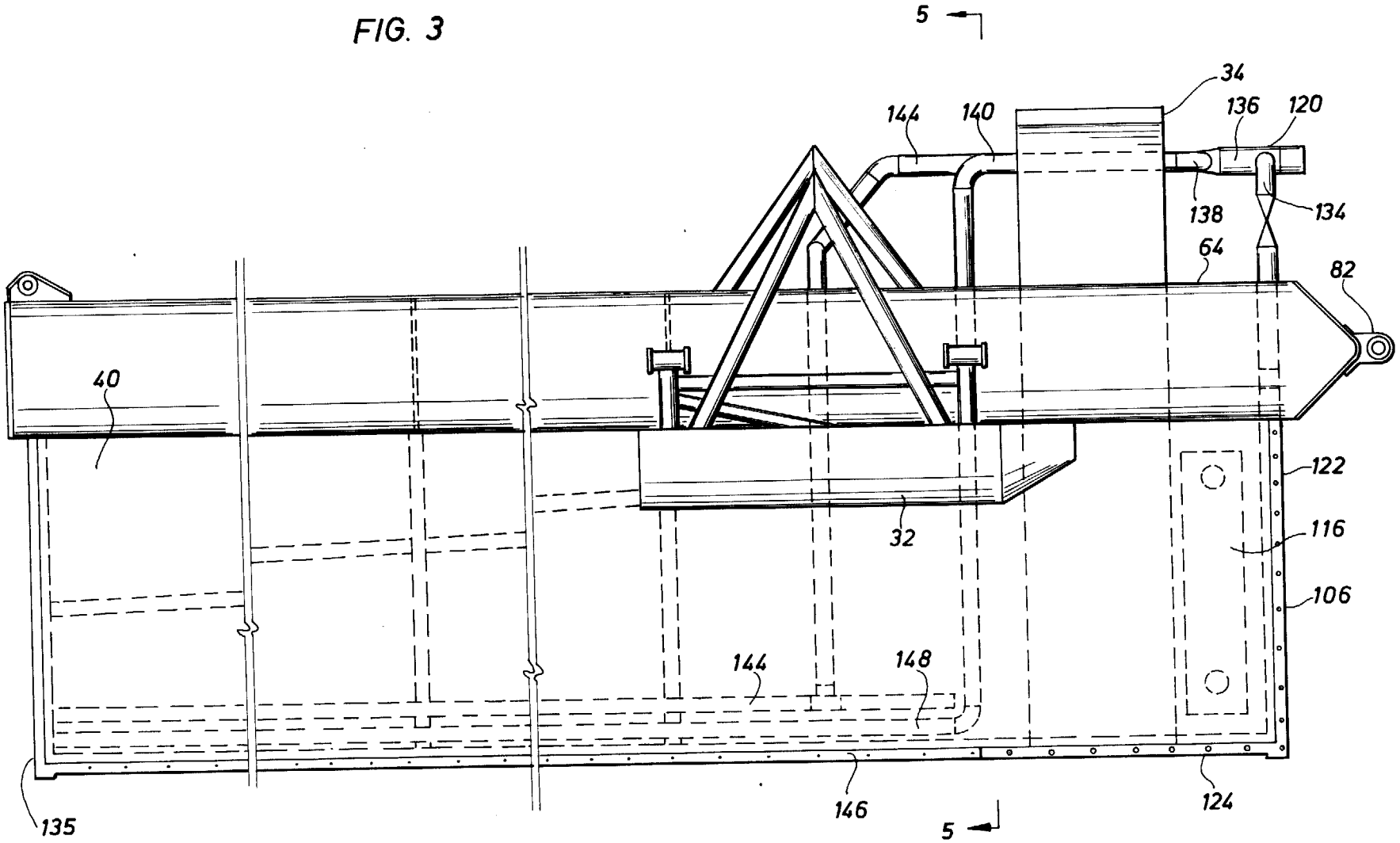
FIG. 3 is an elevation view of a preferred embodiment of the present sand jet sled apparatus illustrating the structural details thereof.
Figure 4:
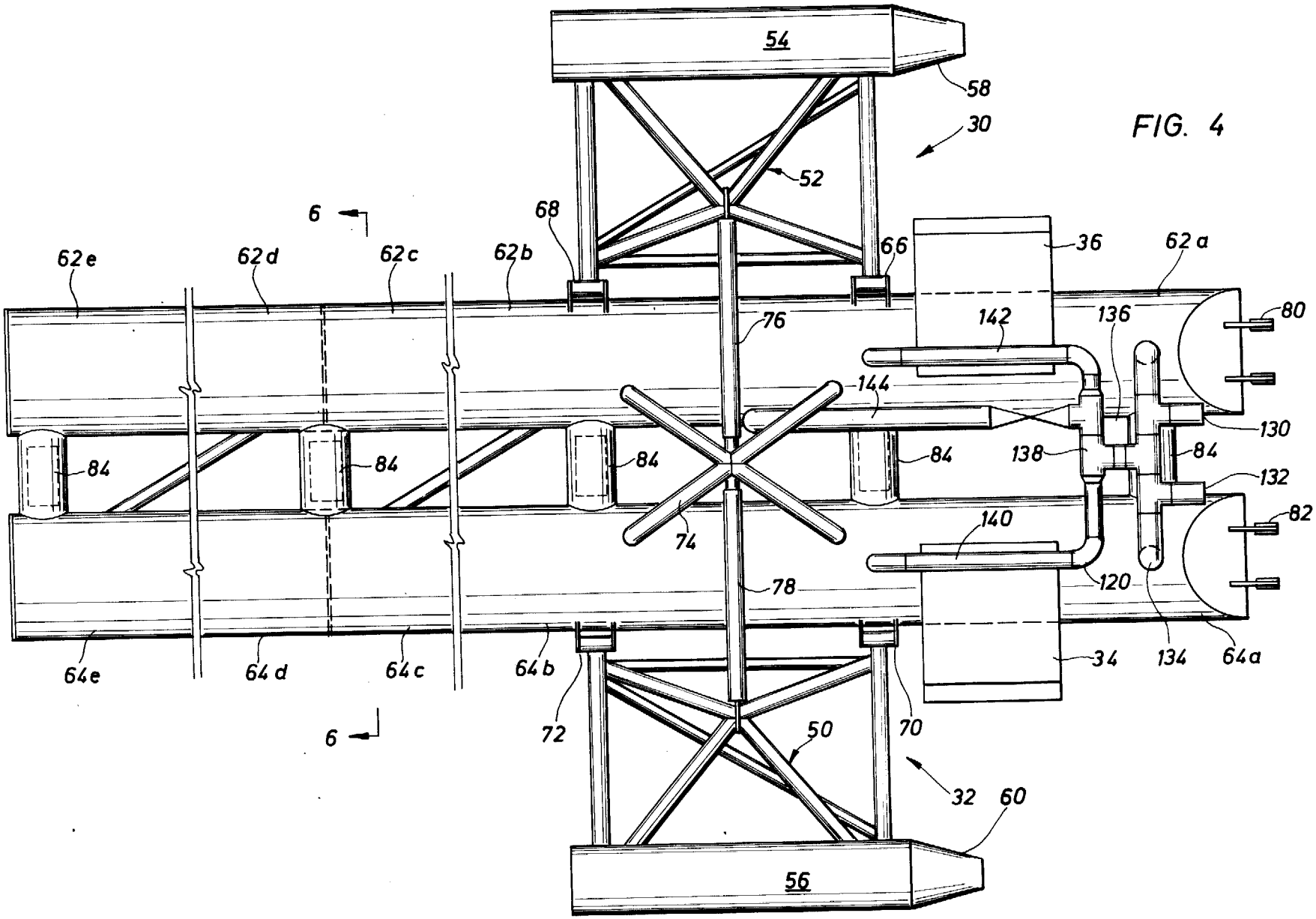
FIG. 4 is a plan view of the sand jet sled apparatus of FIG. 3 illustrating additional details thereof.
Figure 5:
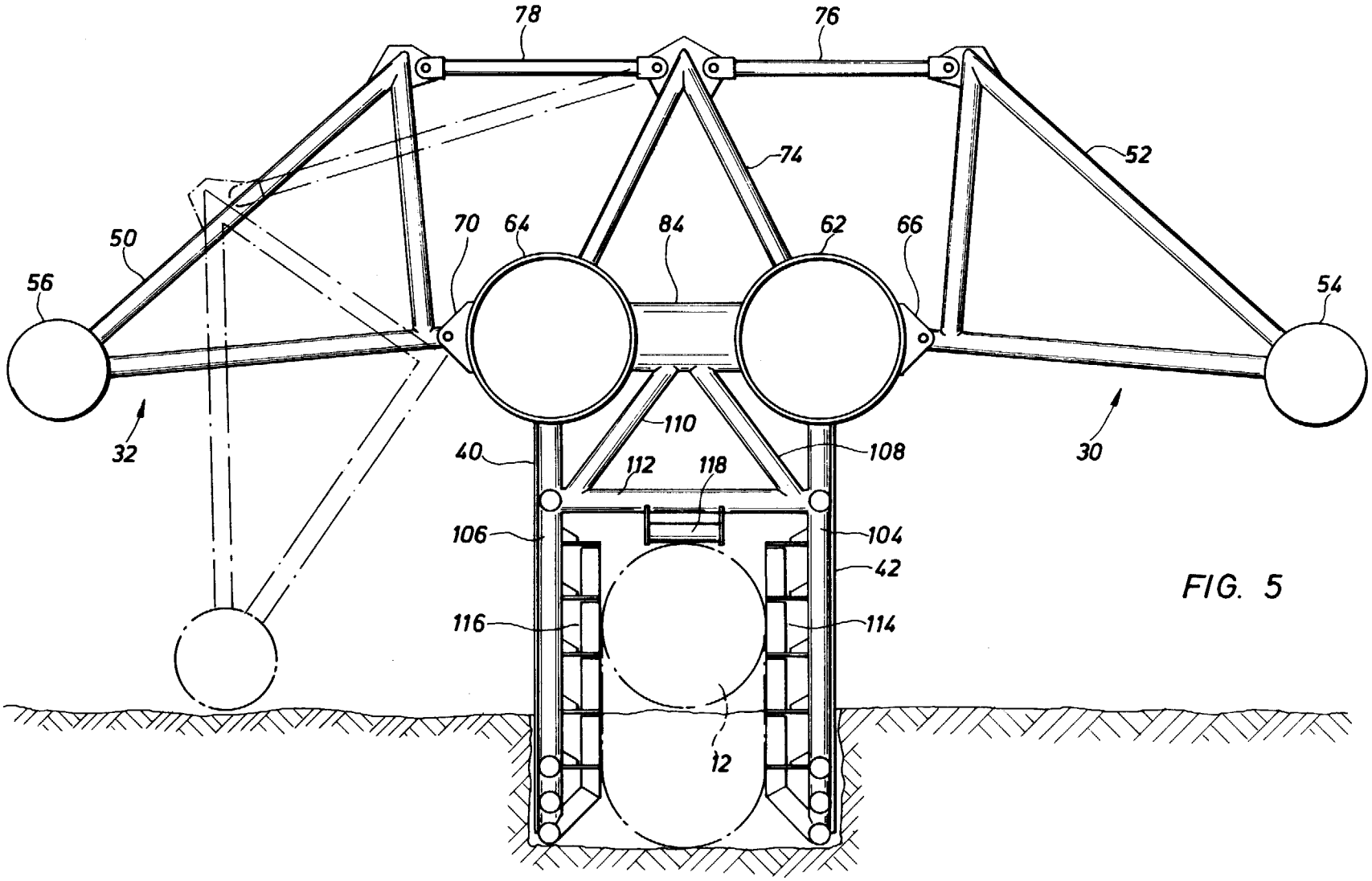
FIG. 5 is a cross-sectional view of the jet sled portion of the apparatus illustrating details of the jetting legs and the outriggers.

Referring now to FIGS. 3, 4, and 5 there is shown elevation, plan and frontal views, respectively, of a preferred bodiment of the sand jet sled apparatus 10.

The sand jet sled apparatus 10 is shown in those views resting on seabed 14 on port and starboard outriggers 30 and 32. Each outrigger comprises a mounting frame designated generally by the reference numerals 50 and 52. In addition, outriggers 30 and 32 each include a pontoon skid 54, 56. Pontoon skids 54 and 56 are hollow, cylindrical members having a tapered end cap 58, 60 attached at the forward portion in an upturned attitude. The outriggers 30 and 32 are designed for sliding along the seabed on opposite sides of the pipeline 12, and for supporting the forward end of sand jet sled apparatus 10. The port and starboard outriggers 30, 32 attach to a pair of elongate, segmented ballast tanks 62, 64 which extend substantially parallel to one another. Outrigger 30 connects to ballast tank 62 by mounting frame 52 with a pair of hinges 66, 68 that secure to the outside of the ballast tank 62. Similarly, outrigger 32 is attached to ballast tank 64 by a pair of hinges 70, 72 on mounting frame 50.

Referring briefly to FIG. 5, the connection arrangement of outriggers 30, 32 to the ballast tanks 62, 64 may be further understood. In addition to the port side hinges 66, 68 and the starboard side hinges 70, 72 which secure the mounting frames 50 and 52 of the outriggers to the ballast tanks, there is also provided an A-frame structure 74 that projects upwardly from the ballast tanks 62 and 64. At the apex of the frame, support bars 76 and 78 having a clevis on each end attach and extend laterally to connect onto outrigger mounting frames 52 and 50, respectively. It will be appreciated that the pair of hinges 66, 68 and 70, 72 each define a pivot axis for their respective outrigger. It will be further appreciated that by varying the length of the connecting bars 76 and 78 that the pivotal disposition of the outriggers about their respective pivot points can be changed, thus effecting adjustment of the depth into the seabed that a trench will be formed.

With reference again to the views of FIGS. 3 and 4, ballast tanks 62 and 64 will be observed to form an elongate member that constitutes the main structural element of the sand jet sled apparatus 10. The ballast tanks 62 and 64 extend substantially parallel, are symmetrical about the centerline axis of the sled, and each comprises five selectively ballastable segments, *a–e*. At the bow portion of each ballast tank is a towing pad eye 80, 82 which together provide a point of attachment for towing line 22. Ballast tanks 62 and 64 are displaced apart with a plurality of support members 84 being used to maintain the spacing of the ballast tanks and provide adequate support along their length.

Each ballast tank segment, *a–e*, is supplied with air from the hose 24 (FIG. 1) that extends down to sand jet sled apparatus 10 from barge 16. In addition, each segment has a manual flooding valve to enable each segment to be filled with seawater and thereby give the elongate member a negative buoyancy. When the seawater ballasted segments are desired to be cleared of water, vent valves may be opened and air introduced into the segments to clear them of seawater and give the structure a positive buoyancy. Thus, at the conclusion of a burying operation when it is desired to raise the sand jet sled apparatus 10 from the seabed below, the ballast tanks 62 and 64 may be filled with air to cause the structure to rise to the surface.

Figure 6:
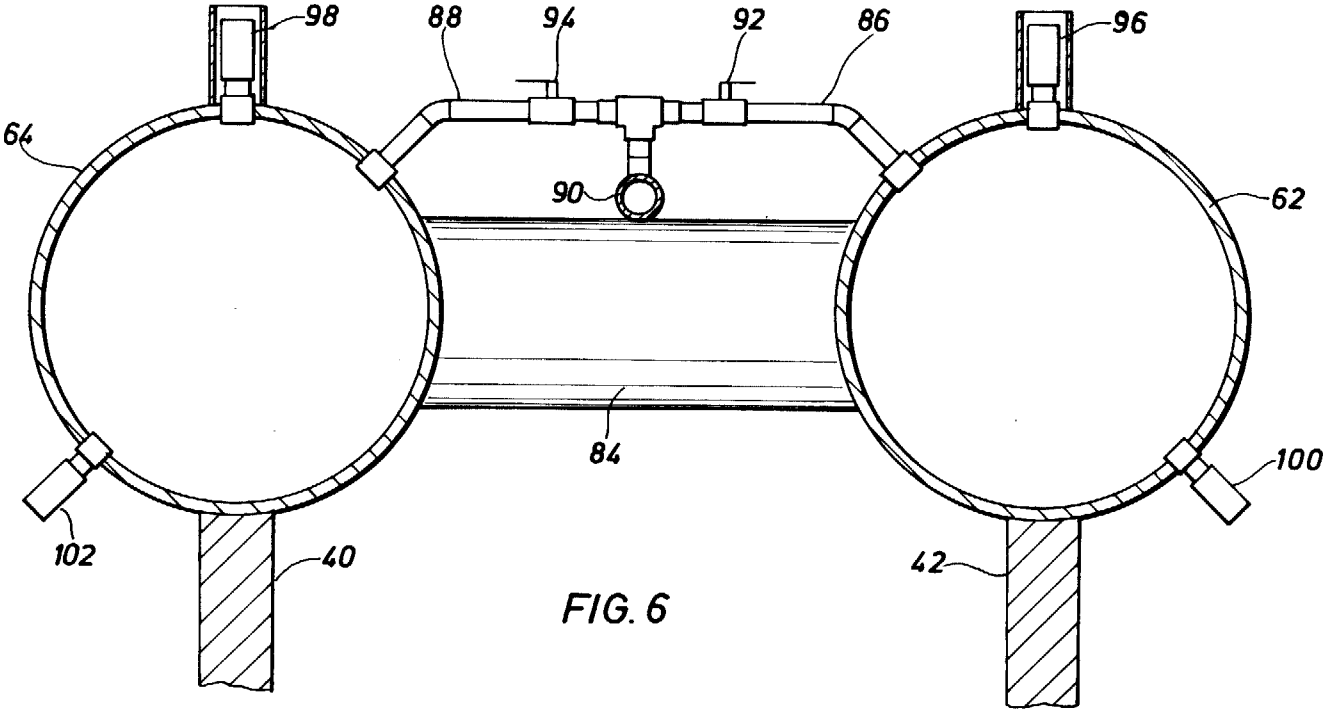
FIG. 6 is a cross-section view of one segment of the twin ballast tanks and the associated equipment for ballasting and deballasting the tanks.

Referring now to FIG. 6, there is illustrated a cross-sectional view of ballast tanks 62 and 64 along with associated ballasting and deballasting equipment. Specifically, conduit branches 86 and 88 from air conduit 90 are supplied to ballast tanks 62 and 64 to introduce air into each segment. The conduit branches 86 and 88 are positioned to enter their respective segment at an angle of 45° with respect to the top of the ballast tank. Manual valves 92 and 94 are provided, which can be opened to permit introduction of ballast air into the ballast tanks and closed to prevent leakage of air from the ballast tanks. Also provided in the top of each segment of ballast tanks 62 and 64 is a vent valve 96, 98 through which air can be vented when sand jet sled 10 is to be sunk. Simultaneously with the venting of the ballast tanks, manual flooding valves 100, 102 are opened to permit the entry of seawater into the respective segment of the ballast tank. Flooding valves 100, 102 are disposed on the underside of their respective tank segment approximately 30° off-vertical.

Referring once again to FIG. 5, the cross-sectional, frontal view illustrated therein provides a view of the jet sled portion of the sand jet sled apparatus 10. Specifically illustrated are the port and starboard jet legs 104 and 106 which depend downwardly from the underside of ballast tanks 62 and 64, respectively. The jet legs used are of conventional design and well known to those skilled in the art of pipeline burying. Bracing structure comprising braces 108, 110 and 112 are provided to strengthen the depending jet legs. A set of rollers 114 having load cells (not shown) associated therewith are attached to jet leg 104, and a corresponding set of rollers 116 are attached to jet leg 106. Further, an additional roller 118 is attached to the underside of support brace 112. During trenching operation, rollers 114, 116 and occasionally 118 will come into contact with pipeline 12 (shown in dotted outline) and roll along over the surface of the pipeline. In addition to roller 118 disposed at the forward end of the jet sled 10, there is also provided a series of rollers 119, shown in outline in FIG. 4, which are each carried on a bracing structure similar to that which carries roller 118. The rollers 119 extend to an increasingly greater distance beneath the elongate member from the forward to the aft portion of the sled, and are spaced along the length of the sled. Preferably, each roller 119 will be positioned at a support member 84. The load cells associated with the roller mechanism 114 and 116 indicate when a cross-pull is being applied to the sled, as when the barge 16 is getting off course.

The arrangement of jet leg 106 may be further observed in FIG. 3, wherein the forward portion of the jet leg is in view. Also in view is water manifold 120 that connects to the forward fluid conduit 122 which has a plurality of jetting nozzles disposed to direct high pressure water flow downwardly into the seabed ahead of the sand jet sled apparatus 10 to form a trench. In addition, another conduit portion 124 of jet leg 106 extends across the lower edge of jet leg 106 and also has a plurality of jetting nozzles for directing a flow of high pressure water into the seabed.

The manifold 120 is also in view in FIG. 4 with the arrangement above both ballast tank 62 and ballast tank 64 being shown. Manifold 120 has two inlet ducts 130 and 132 to which water hoses 26 and 28 (FIG. 1) from barge 16 connect. Ducts 130 and 132 terminate into a first reservoir portion 134 that turns downwardly at the ends to connect into and supply jetting water to the forward fluid conduit 122 (FIG. 3) of each jet leg. An intermediate duct 136 connects the first reservoir portion 134 into a second reservoir portion 138 having two conduits 140 and 142 that connect to the ends of reservoir 138 and extend rearwardly. Conduits 140 and 142 supply jetting water to the jetting conduit network associated with the sand shields 40 and 42 to be described more fully hereinafter. Finally, a recovery conduit 144 is connected to second reservoir portion 138 to provide a complete circuit path for jetting water which has not been expelled through the jetting nozzles along the shields.

In addition to the jetting nozzles provided in each jet leg, there is also an air lift exhaust mechanism 34 and 36. The air lift mechanisms are supplied with air from barge 16 via line 24 to create a vacuum suction near the lower edge of each jet lag to cause the material excavated to be drawn by suction out from the trench and expelled to each side of the sand jet sled apparatus.

The jet sled portion of sand jet sled apparatus 10 performs the function of creating a trench ahead of the sand sled apparatus that is of proper dimensions to accommodate the pipeline.

On each side of the sand jet sled apparatus 10 and extending over substantially the entire length of the apparatus are the shields 40, 42 which depend from the underside of each ballast tank. The shields are preferably a plate of high strength material such as steel. Each shield has a depth dimension that is slightly greater than the depth of the trench into which the pipeline is to be buried. Further, the shields 40, 42 are disposed apart a distance that is approximately equa to the width of the trench formed by the jet legs. The shields 40 and 42 serve to physically restrain the walls of the trench and prevent them from caving in and thus filling the trench beneath the unsupported length of the pipeline that is being laid.

With continuing reference to FIG. 3, there is shown in dotted outline a fluid conduit arrangement extending along the length of sand jet sled apparatus 10 behind shield 40. A similar conduit arrangement is provided for shield 42. This conduit network comprises an air line 146 that extends along the lower edge of shield 40 with a plurality of pairs of holes drilled therein to expell air laterally both inwardly into the trench and outwardly into the wall of the trench. In addition, a water jet conduit 148 is provided having a plurality of small jetting nozzles, each directed inwardly and downwardly into the trench that is formed. Finally, the conduit network comprises a recovery conduit 144 having a plurality of laterally directed nozzles for directing fluid into the wall of the trench. Both air conduit 146 and water conduit 148 empty into a collection conduit 135 at the rear of jet sled apparatus 10. Collection conduit 135 is also in communication with recovery conduit 144. A bracing structure comprising a network of interconnected tubular members supports the fluid conduit system along the inside of shield 40.

The operation of the above described apparatus in a pipeline burying function begins with the sinking of the sand jet sled apparatus 10 to the seabed, by flooding of the ballast tanks 62, 64, into straddling disposition over the submerged pipeline 12 to be buried. Once in position over the pipeline, jetting action is begun with high pressure water from pumps aboard barge 16 being supplied to the jet legs 104, 106. Water expelled from the nozzles is injected into the seabed to dislodge seabed material and form a trench beneath the pipeline. Simultaneously with the jetting, air is supplied to the airlift mechanisms in the jet legs to suck dislodged seabed material from within the trench formed. The sand jet sled apparatus is moved along the pipeline 12 is tow behind barge 16 with jetting action continuing. The apparatus settles into the trench formed such that the shields mounted along each side of the apparatus on opposite sides of the pipeline are inside the trench adjacent the trench walls.

The portion of the pipeline ahead of the jet sled will be supported by the surface of the seabed. The portion of the pipeline behind the apparatus, however, will be laying at the bottom of the trench which is, of course, several feet lower than the seabed surface. Therefore, the portion of the pipeline between the seabed surface and the trench bottom will be unsupported. To prevent unconsolidated seabed material, such as sand, from filling in beneath the unsupported portion of the pipeline as it is entrenched, the shields physically restrain the walls of the trench.

Further assistance in preventing the filling-in of the trench beneath the unsupported pipeline portion is provided by the air and water jet nozzles disposed behind and near the lower edge of each shield. The nozzles are provided with pressurized air or water to create a fluid stream directed outwardly through the shields and into the trench wall, as well as into the seabed to maintain fluidization of only a small portion of the seabed near the bottom of the trench.

The weight of the ballast seawater contained in tanks acts on the pipeline through the rollers that are in bearing engagement with the top of the pipeline to force down on the pipeline and assist it in settling into the fluidized seabed at the bottom of the trench.

After the shields on the apparatus have passed a particular segment of the pipeline which is then laying on the bottom of the trench without substantial accumulation of material beneath the pipeline, the walls of the trench can cave-in to cover over the pipeline. Of course, additional jetting equipment may be brought along behind the sand jet sled apparatus to cause the pipeline to be more rapidly covered.

At the completion of a pipeline burying operation, the ballast tanks are deballasted to create a positive buoyancy for the sand jet sled, which will assist in raising the apparatus to the surface. Although cranks provided on the surface barge might be used in raising the apparatus, the positive buoyancy force affords a significant lifting force. Because of the magnitude of the buoyancy force, it is necessary to assure uniform distribution along the length of the sand jet sled to prevent damaging deformation of the structural components. Thus, the ballast tanks, or other ballasting means, preferably extend over sustantially the entire length of the sand jet sled.

The foregoing description of the invention has been directed to a particular preferred embodiment of the present invention for purposes of explanation and illustration. It will be apparent, however, to those skilled in this art that many modifications and changes in the apparatus may be made without departing from the scope and spirit of the invention. It is therefore intended that the following claims cover all equivalent modifications and variations as fall within the scope of the invention as defined by the claims.

What is claimed is:

1. Apparatus for entrenching a submerged pipeline in a seabed, comprising:

a jet sled adapted to straddle the submerged pipe laying on the seabed, said jet sled having jet legs depending downwardly therefrom for forming a trench in the seabed for the pipeline;

an elongate member extending from the rear of the jet sled; and shields attached to said member and disposed on opposite sides of the unsupported portion of the pipeline extending from the surface of the seabed to the bottom of the trench, said shields preventing unconsolidated material from filling in the trench beneath the unsupported length of the pipeline.

2. The apparatus of claim 1 further comprising jetting means carried by said shields for directing a flow of pressurized fluid outwardly from said shields to assist in preventing unconsolidated material from filling the trench.

3. The apparatus of claim 1 wherein said jet sled comprises first and second outriggers extending laterally of said elongate member on opposite sides of the submerged pipeline to support the jet sled over the submerged pipeline.

4. The apparatus of claim 3 wherein said outriggers are pivotally attached to said elongate member and are adjustable to dispose said jet legs at various depths within the seabed.

5. The apparatus of claim 4 wherein said outriggers comprise:

a mounting frame having a hinge formed thereon; and a pontoon secured to said mounting frame for sliding along on the seabed surface.

6. The apparatus of claim 1 wherein said elongate member comprises at least one elongate ballast tank disposed substantially symetrically about the centerline axis of the elongate member.

7. The apparatus of claim 6 wherein each of said ballast tanks is provided with at least one flooding valve for admitting liquid ballast material into said tank, and further provided with a source of pressurized gas for expelling the liquid ballast material from said tank.

8. The apparatus of claim 7 wherein each of said ballast tanks is divided into a plurality of separate ballastable and deballastable chambers.

9. The apparatus of claim 6 further comprising:

means to selectively ballast and deballast said ballast tank to sink said elongate member to the seabed and to raise said elongate member to the surface.

10. The apparatus of claim 1 wherein the jet legs on said jet sled comprise:

forward fluid jet conduits having a plurality of nozzles formed thereon for directing a stream of high pressure fluid into the seabed ahead of said jet sled;

a set of vertically oriented rollers disposed inwardly toward the pipeline; and an exhaust mechanism for drawing dislodged seabed material from the area of the trench inside said shields and depositing dislodged material to the side of the trench outside the shields.

11. The apparatus of claim 1 wherein said shields are plates that depend vertically, downwardly from said elongate member extending over a portion of the length of said elongate member and having a depth dimension that approximates the depth of the trench formed by said jet legs.

12. The apparatus of claim 1 wherein:

said elongate member carries a series of rollers spaced at locations therealong for bearing engagement with the pipeline, each one of said rollers from the forward to the aft portion of the elongate member extending a greater distance into the trench than the preceding roller; and said elongate member carries ballast to create a downward force acting on the pipeline through said series of rollers to force the pipeline into the trench.

13. Apparatus for entrenching a submerged pipeline in a seabed, comprising:

an elongate member having jetting nozzles attached thereto and disposed on opposite sides of the pipeline to fluidize the seabed proximate the pipeline;

a series of rollers carried by said elongate member spaced at locations therealong for bearing engagement with the pipeline, each one of said rollers from the forward to the aft portion of the elongate member extending a greater distance beneath the elongate member than the preceding roller; and a ballast carried by said elongate member to increase the submerged weight thereof and increase the downward force applied to the pipeline through said rollers to fore the pipeline into the seabed.

14. The apparatus of claim 13 wherein said elongate member comprises at least one ballast tank, with said ballast being contained within the tank.

15. The apparatus of claim 14 further comprising means to selectively ballast and deballast said ballast tank to adjust the downward force acting on the pipeline.

16. Apparatus for entrenching a submerged pipeline in a seabed consisting of unconsolidated material, comprising:

first and second jet legs disposed on opposite sides of the submerged pipeline for forming a trench within the seabed to accommodate the pipeline;

an elongate ballast tank extending rearwardly of said first and second jet legs;

port and starboard outriggers, each mounted to said elongate ballast tank and adapted to straddle the submerged pipeline laying on the seabed;

first and second shields, each attached to said ballast tank, for disposition on opposite sides of the submerged pipeline inside the walls of the trench, said shields extending the length of the unsupported portion of the pipeline between the surface of the seabed and the bottom of the trench to prevent unconsolidated seabed material from filling the trench before the pipeline has sunk to the desired depth within the trench; and means to selectively ballast and deballast said elongate ballast tank to raise and lower the trenching apparatus between a submerged seabed location and the surface of a body of water.

17. The apparatus of claim 16 further comprising jetting means associated with each of said shields for directing a flow of pressurized fluid outwardly from said shields against the walls of the trench to assist in preventing unconsolidated seabed material from entering the trench beneath the pipeline.

18. The apparatus of claim 17 wherein said ballast tanks is segmented into a plurality of separate chambers.

19. The apparatus of claim 18 wherein said outriggers are pivotally attached to the side of said ballast tank with adjustment means attaching to the outriggers to effect various depths of penetration of said jetting legs into the seabed.

20. The apparatus of claim 19 wherein said jet legs each comprise a plurality of fluid jet nozzles being supplied high pressure water from a manifold, and include an air lift mechanism for removing dislodged seabed material from within the trench formed.

21. The apparatus of claim 16 wherein:

said elongate member carries a series of rollers spaced at locations therealong for bearing engagement with the pipeline, each one of said rollers from the forward to the aft portion of the elongate member extending a greater distance into the trench than the preceding roller; and said elongate member carries ballast to increase the downward force applied to the pipeline through said series of rollers and force the pipeline into the trench.

* * * * *